United States Patent [19]

Elias

[11] Patent Number: 4,486,360

[45] Date of Patent: Dec. 4, 1984

[54] CARBURETOR

[75] Inventor: Allan Elias, 6211 Yarrow Dr., Carlsbad, Calif. 92008

[73] Assignee: Allan Elias, Monpa, Nev.

[21] Appl. No.: 394,159

[22] Filed: Jul. 1, 1982

[51] Int. Cl.[3] ..... F02M 7/22

[52] U.S. Cl. ..... 261/39 D; 261/39 E; 261/121 B; 261/67; 261/50 A; 137/599.2

[58] Field of Search ..... 261/39 D, 39 E, 121 B, 261/67, 50 A; 137/559.2

[56] References Cited

U.S. PATENT DOCUMENTS

| | | | |
|---|---|---|---|
| 1,242,245 | 10/1917 | Rutz | 137/599.2 |
| 2,694,412 | 11/1954 | Jaros | 137/599.2 |
| 2,981,245 | 4/1961 | Sarto | 261/39 D |
| 3,493,217 | 2/1970 | Farley | 261/121 B |
| 3,810,606 | 5/1974 | Masaki | 261/121 B |
| 4,118,444 | 10/1978 | Abbey | 261/50 A |
| 4,298,549 | 11/1981 | Woodworth | 261/50 A |
| 4,318,070 | 3/1982 | Dohrmann | 261/39 E |
| 4,393,012 | 7/1983 | Kato et al. | 261/121 B |

*Primary Examiner*—Tim R. Miles

*Attorney, Agent, or Firm*—Harris, Kern, Wallen Tinsley

[57] ABSTRACT

A carburetor with a fuel nozzle in the throat, an upstream butterfly valve, a downstream butterfly valve, a first vacuum actuator for controlling the upstream butterfly valve as a function of vacuum in the throat, and a second vacuum actuator for controlling pre-mix air supply to the fuel nozzle as a function of vacuum downstream from the downstream butterfly valve. A cold start control for disabling the second vacuum actuator for a predetermined period of time at starting to block flow of pre-mix air to the fuel nozzle, including a cold start valve with a thermal responsive bimetal and a resistance heater for timing of the cold start operation. A main fuel control valve with an idle bypass passage therethrough, and means for adjusting the rate of flow through the idle bypass passage.

7 Claims, 7 Drawing Figures

CARBURETOR

BACKGROUND OF THE INVENTION

This invention relates to carburetors, and in particular, to carburetors of the type described in U.S. Pat. No. 4,298,549.

There is a continuing demand for improved internal combustion engines in terms of performance, fuel efficiency and pollution, and one of the significant components in achieving these sometimes conflicting improved performances is the carburation. Some carburetor designs which are satisfactory during normal operation encounter problems with cold starting of the engine. One conventional approach to improved cold starting is to enrich the air-fuel mixture during starting, and this has been accomplished by various means in past designs. One object of the present invention is to provide a new and improved cold starting carburetor and in particular, a carburetor design which has improved cold starting while being simple and reliable. A further object is to provide a carburetor utilizing a pre-mix air supply to the fuel nozzle, with the amount of air supplied being varied during normal operation of the engine, and with this pre-mix air supply being shut off for cold starting. An additional object is to provide such a carburetor in which the duration of the cold start function is determined by a timing operation rather than by engine operation.

In present carburetor designs, such as that shown in the aforesaid U.S. Pat. No. 4,298,549, a valve member moves to control flow of fuel to the fuel nozzle of the carburetor. In order to maintain the engine running during idling, a bypass passage is provided through the valve member so that there is always a small and predetermined flow of fuel for idling. However, the amount of fuel flow required for idle varies with different engine sizes and when a carburetor utilizes a bypass passage in the fuel valve member, different members with different size passages have to be provided for different engine sizes. Accordingly, it is another object of the present invention to provide a fuel valve with adjustable idle bypass passage, permitting use of a single carburetor with various engine sizes.

These and other objects, advantages, features and results will more fully appear in the course of the following description.

SUMMARY OF THE INVENTION

The invention of the present application is intended for use with a carburetor for an internal combustion engine, with the carburetor having a throat, a first butterfly valve upstream of the throat, a second butterfly valve downstream of the throat, an outlet downstream of the second butterfly valve, a fuel nozzle in the throat, a pre-mix air supply passage providing an air flow path from the exterior of the carburetor to the fuel nozzle, a needle valve in this air flow path, a vacuum actuator for actuating the needle valve, a vacuum line connecting the outlet of the carburetor to the vacuum actuator, a fuel reservoir, another internal passage defining a fuel flow path between the fuel reservoir and the fuel nozzle, a fuel valve for controlling flow through said latter passage, a rod for the first butterfly valve and including an eccentric cam, and a cam follower lever driven by the cam for controlling the fuel valve.

One embodiment of the invention includes means for disabling the vacuum actuator to close the air flow path of the pre-mix air supply passage for a predetermined time thereby blocking flow of pre-mix air to the nozzle during starting of the engine. This may be accomplished by utilizing a heater and thermal responsive bimetal as a cold start valve. In one embodiment the cold start valve blocks the vacuum line to the vacuum actuator for a predetermined period of time determined by the length of time required for the heater to actuate the bimetal. In another embodiment, the cold start valve is mounted on the vacuum actuator and blocks air flow to the needle valve during the cold start period.

In another embodiment of the invention, the fuel valve includes a sleeve mounted in a passage of the carburetor, a piston slidably positioned within the sleeve, and a plunger positioned within the piston. Movement of the piston within the sleeve controls the main flow of fuel, with a spring urging the piston to the closed position, and the cam driven lever moving the piston toward the open position. The idle fuel supply flows through the piston, with the rate of flow controlled by the position of the plunger within the piston, which may be adjusted as by means of a screwdriver.

DESCRIPTION OF THE PREFERRED EMBODIMENTS

The carburetor of the present invention is an improvement over the carburetor shown in the aforesaid U.S. Pat. No. 4,298,549, particularly that shown in FIGS. 18–25. The present application will be directed primarily to a showing of the improved portions of the carburetor, and reference may be made to said patent for details of construction and operation of other aspects of the carburetor.

Figure 1:
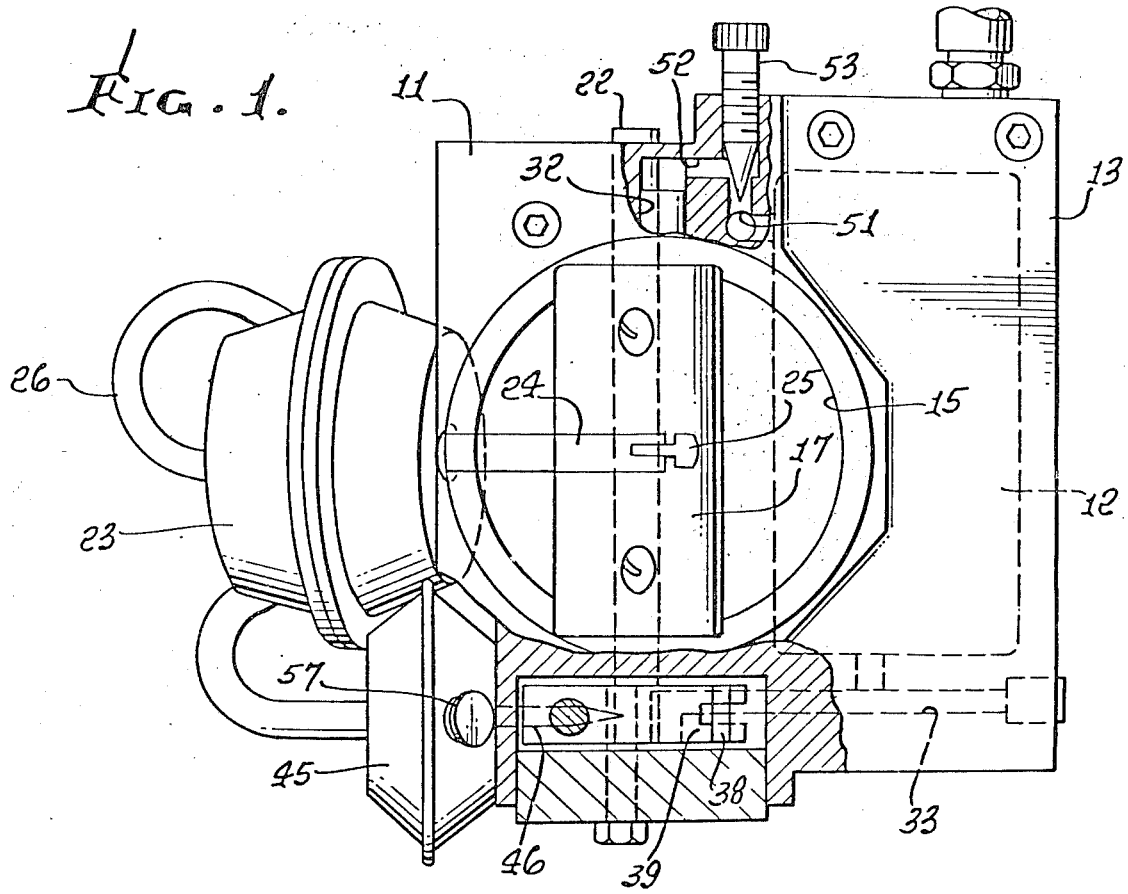
FIG. 1 is a top view, partly in section, of a carburetor incorporating the presently preferred embodiment of the invention.
Figure 2:
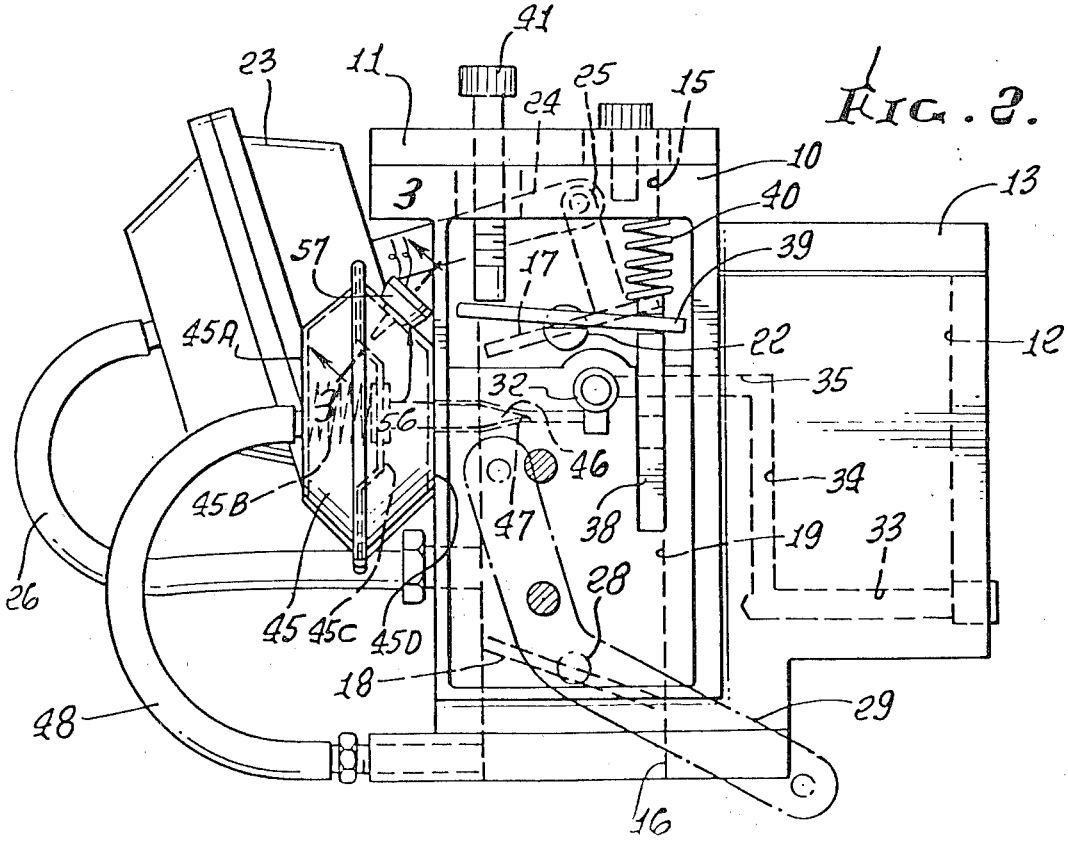
FIG. 2 is a side view of the carburetor of FIG. 1.
Figure 3:
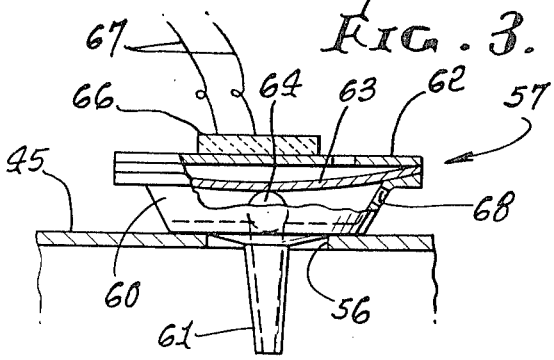
FIG. 3 is an enlarged partial sectional view taken along the line 3—3 of FIG. 2.

Referring to the embodiment of FIGS. 1–3, the carburetor includes a housing 10 with cover plate 11, the housing including a fuel reservoir 12 with cover plate 13. The housing includes an upper inlet 15 and a lower outlet 16, with an upstream butterfly air valve 17 and a downstream butterfly valve 18 defining a throat 19 therebetween.

The upstream butterfly 17 is carried on a rod 22 and is driven by a vacuum actuator 23 and linkage 24, 25. The vacuum actuator 23 is connected to the throat 19 by vacuum line 26. The downstream butterfly 18 is carried on a rod 28 driven by a crank 29.

Fuel flows from the fuel reservoir 12 to a fuel nozzle 32 positioned in the throat 19 through passages 33, 34 and 35. Fuel flow is controlled by a valve member 38 in the passage 35, with the valve member being translated by a cam follower lever 39 driven by a cam on the rod 22. A spring 40 urges the member 38 downward, with downward motion being limited by a stop screw 41.

A second vacuum actuator 45 drives a needle 46 in a passage 47 between the actuator 45 and the nozzle 32. The actuator 45 is connected to the outlet 16 of the carburetor by a line 48. The actuator 45 and needle 46 provide control of atmospheric air to the nozzle 32, providing pre-mix air for the fuel at the nozzle as a function of vacuum at the carburetor outlet.

The vacuum actuators 23 and 45 are conventional units and the internal configuration of the actuator 45 is shown in FIG. 2. The actuator 45 includes a cover 45A and a base 45D, with a diaphragm 45C clamped between the base and cover. A spring 45B is positioned between the cover and diaphragm, urging the diaphragm to the right. The needle 46 is mounted on the diaphragm 45C and moves in the needle passage 47.

Fuel for idling is provided from the reservoir 12 to the fuel nozzle 32 through passages 51, 52, with the rate of flow being controlled by a needle 53.

The carburetor described thus far corresponds to the carburetor of FIGS. 18–22 of said U.S. Pat. No. 4,298,549.

In the improved carburetor of the present invention, the pre-mix air is supplied to the passage 47 through an opening at 56 of the vacuum actuator 45. A valve 57 is mounted in this opening, and this valve is shown in greater detail in FIG. 3.

The valve 57 includes a housing 60 with a nozzle projecting through the opening 56, a cover 62, and a thermal responsive bimetal element 63 positioned between the housing and cover. A ball 64 is carried on the bimetal 63 and closes the nozzle 61 when in the position shown in FIG. 3. A heating element 66, preferably a ceramic resistance element, is mounted on the cover 62 and is connected to an electric power source by conductors 67. There is an opening 68 in the cover 60 providing for flow of atmospheric air through the nozzle 61 when the bimetal 63 is heated and bows upward moving the ball 64 away from the nozzle 61. In operation, the valve is in the position shown in FIG. 3 when the engine is not operating. When the ignition is turned on, electric power is applied to the conductor 67 to heat the element 66. After a predetermined period of time, determined by the parameters of the valve, typically one minute at 70° F., the heater 66 has produced sufficient heat to cause the bimetal to bow upward, moving the ball 64 away from the nozzle 61, and opening the air flow path from the atmosphere to the fuel nozzle 32 through the vacuum actuator 45 and needle valve passage 47. Then the flow of pre-mix air is controlled by the vacuum actuator. However during the initial period of time while the cold start valve 57 is closed, there is no pre-mix air being introduced and the air-fuel mixture is enriched, as desired for starting.

Figure 5:
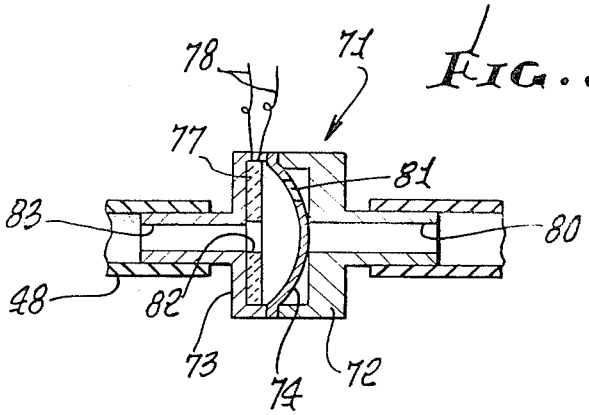
FIG. 5 is an enlarged partial sectional view taken alog the line 5—5 of FIG. 4.
Figure 4:
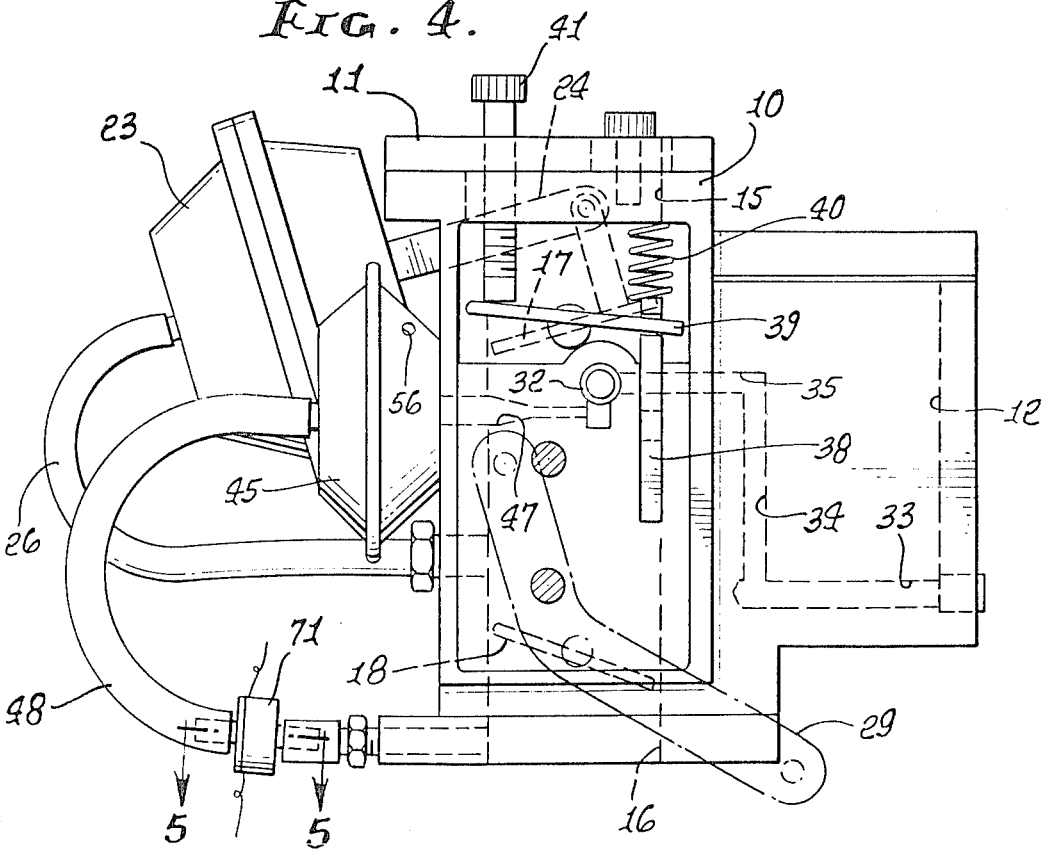
FIG. 4 is a view similar to that of FIG. 2 showing an alternative embodiment of the invention.

An alternative embodiment of the invention is shown in FIGS. 4 and 5, where components corresponding to those of the embodiments of FIGS. 1–3 are identified by the same reference numerals. In this embodiment, the cold start valve 57 is omitted, leaving the opening 56 unobstructed. A somewhat similar cold start valve 71 is inserted in the vacuum line 48 between the outlet 16 and the vacuum actuator 45.

The cold start valve 71 is shown in greater detail in FIG. 5 and includes a body 72 and a cover 73 with a thermal responsive bimetal 74 therebetween. An annular heating element, typically a ceramic resistance element, 77 is positioned in the cover 73 and is energized by conductors 78.

In operation, with the thermal responsive element 74 cold, it is bowed to the right as viewed in FIG. 5, closing the flow path through the vacuum line 48. When the thermal responsive element is heated by the heater, the thermal responsive element moves to the left, providing an open flow path through passage 80 in the body 72, opening 81 in the element 74, opening 82 in the heating element 77 and passage 83 in the cover 73. When the valve 71 is in the position shown in FIG. 5 during initial starting, the vacuum line 48 is blocked and the needle 46 moves to the right closing the pre-mix air flow path between the opening 56 and the fuel nozzle 32. After the predetermined time has elapsed, as determined by the characteristics of the valve 71, the vacuum line 48 is in the open condition and the vacuum actuator 45 operates as a demand control for controlling the amount of pre-mix air introduced into the carburetor.

Figure 6:
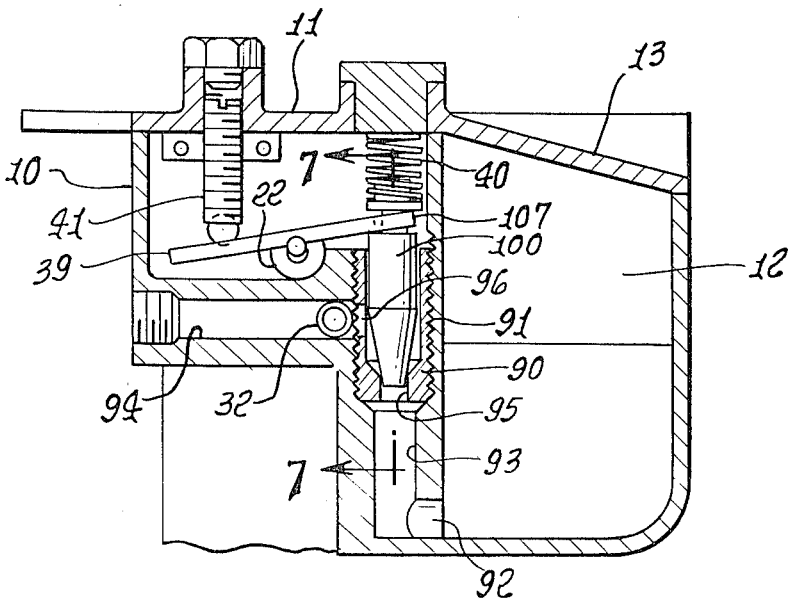
FIG. 6 is a partial sectional view similar to that of FIG. 2, showing another alternative embodiment of the invention.
Figure 7:
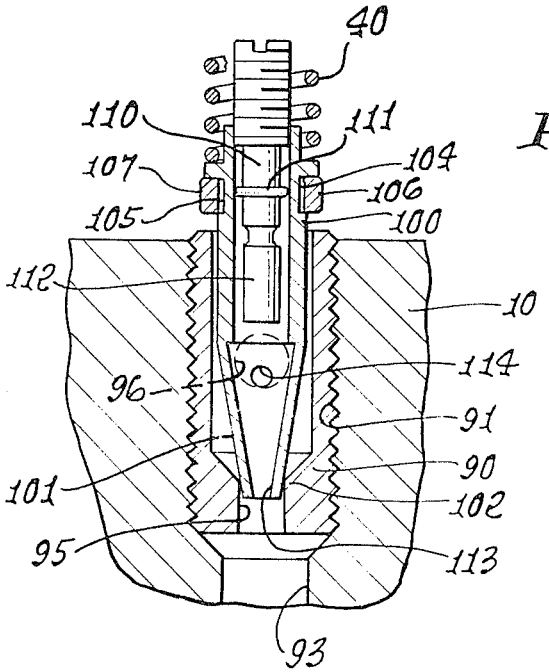
FIG. 7 is an enlarged partial sectional view taken along the line 7—7 of FIG. 6.

The alternative embodiment of FIGS. 6 and 7 is based on the carburetor shown in FIGS. 23–25 of said U.S. Pat. No. 4,298,549. In the new carburetor of the present invention, a sleeve 90 is threaded into a passage 91 in the carburetor 10. There is a fuel flow path through the sleeve 90 from the reservoir 12 to the nozzle 32 defined by passages 92, 93 and 94 in the housing 10, and by an axial opening 95 and a lateral opening 96 in the sleeve 90.

A piston 100 slides in the sleeve 90, with the lower end 101 of the piston tapered to engage a seat 102 of the sleeve 90. The piston 100 is urged downward to the position shown in FIG. 7 by the spring 40. Opposed grooves 104, 105 are provided adjacent the upper end of the piston 100 with flat parallel faces. Spaced fingers 106, 107 of the cam follower lever 39 ride in the respective grooves 104, 105 and move the piston upward against the action of the spring 40, the lever 39 being driven by the cam on the rod 22, as in the carburetor described in said U.S. patent.

A plunger 100 is threadly mounted within the piston 100, with the plunger and piston having interengaging threads at their upper ends. An O-ring 111 is carried in an annular groove of the plunger 110 to provide a seal between the plunger and the interior passage of the piston. The lower end 112 of the plunger preferably is cylindrical with a flat face, as shown in FIG. 7. There is an axial opening 113 at the lower end of the piston, and a lateral opening 114 above the axial opening, preferably in the conical tapered lower section 101.

In operation, there is fuel flow from the reservoir 12 through the axial opening 95 of the sleeve 90, over the seat 102, and outward through the lateral opening 96 of the sleeve to the nozzle 32. The rate of flow of fuel along this path is controlled by the position of the piston 100.

Also there is an idle bypass fuel path through the valve, with fuel flowing through the axial opening 113 of the piston 101 and outward through the lateral opening 114 of the piston and the lateral opening 96 of the sleeve. There is fuel flow through this idle bypass path when the piston is seated in the sleeve, as shown in FIG. 7. The rate of flow through this bypass path is controlled by the position of the plunger 110. For purposes of clarity, the plunger is shown in the full open position in FIG. 7. However the plunger can be screwed down in the piston to reduce the rate of flow of idle fuel to the desired amount.

I claim:

1. In a carburetor having a fuel reservoir, a fuel nozzle, a first internal passage defining a fuel flow path between said fuel reservoir and said fuel nozzle with said passage having a first axial section and a second lateral section, a valve for controlling flow through said first passage with said valve axially movable in said axial section for controlling fuel flow through said axial section, a butterfly valve rod with an eccentric cam, and a cam follower lever driven by said cam for controlling said valve for moving said valve axially in said axial section over a continuous range of positions for varying the rate of flow of fuel to the carburetor, an improved idle bypass in said valve for providing a constant and adjustable flow of fuel to the carburetor in conjunction with the flow of fuel through said valve, comprising in combination:

a sleeve mounted in said first axial section of said first passage, said sleeve having a second internal passage coaxial with said first axial section and with an axial opening with a valve seat and a lateral opening aligned with said second lateral section;

a piston slidingly positioned in said second internal passage of said sleeve for motion toward and away from said valve seat providing a variable range of spacings between said piston and said valve seat, said piston having a third internal passage with an axial opening aligned with said axial opening of said sleeve and a lateral opening alignable with said lateral opening of said sleeve and said lateral section, said piston including means engagable by said lever for moving said piston away from said valve seat, said piston having an inner end with a conical outer surface tapering toward said piston axial opening and a conical inner surface, with said piston lateral opening in said conical surfaces;

a spring urging said piston toward said valve seat whereby said lever and said spring cooperate to maintain said piston spaced relative to said valve seat over a continuous range of distances; and a plunger threadedly mounted in said third internal passage of said piston, with said plunger movable toward and away from said axial opening of said piston for adjustably controlling fuel flow through said third internal passage, said plunger having a cylindrical end with a flat face movable into said piston inner end opposite said piston lateral opening.

2. A carburetor as defined in claim 1 wherein said piston has opposed slots with parallel flat faces for engagement by said lever.

3. A carburetor as defined in claim 2 wherein said sleeve has a threaded external surface for engagement with a corresponding threaded opening in the carburetor body.

4. In a carburetor for an internal combustion engine, said carburetor having a throat, a first butterfly valve upstream of said throat, a second butterfly valve downstream of said throat, an outlet downstream of said second butterfly valve, a fuel nozzle in said throat, a pre-mix air supply passage providing an air flow path from the exterior of said carburetor to said nozzle, a needle valve in said air flow path, a vacuum actuator for actuating said needle valve, and a vacuum line connecting said outlet to said vacuum actuator, the improvement wherein said vacuum actuator has an opening to atmospheric air, and comprising means for disabling said vacuum actuator to close said air flow path for a predetermined period of time blocking flow of pre-mix air to said nozzle during starting of the engine, said disabling means having a cold start valve positioned at said opening, with said valve having an open position providing communication between the atmosphere and said valve actuator opening, and a closed position blocking communication between the atmosphere and said valve actuator opening.

5. A carburetor as defined in claim 4 wherein said cold start valve includes a thermal responsive element for said open and closed operation, and a resistance heater for heating said thermal responsive element.

6. In a carburetor for an internal combustion engine, said carburetor having a throat, a first butterfly valve upstream of said throat, a second butterfly valve downstream of said throat, an outlet downstream of said second butterfly valve, a fuel nozzle in said throat, a first pre-mix air supply passage providing an air flow path from the exterior of said carburetor to said nozzle, a needle valve in said air flow path, a vacuum actuator for actuating said needle valve, a vacuum line connecting said outlet to said vacuum actuator, a fuel reservoir, a second internal passage defining a fuel flow path between said fuel reservoir and said fuel nozzle, a fuel valve for controlling flow through said second passage, a first butterfly valve rod with an eccentric cam, and a cam follower lever driven by said cam for controlling said fuel valve, the improvement comprising in combination:

a sleeve mounted in said second passage, said sleeve having a third internal passage with an axial opening with a valve seat and a lateral opening;

a piston slidingly positioned in said third internal passage of said sleeve for motion into and out of engagement with said valve seat, said piston having a fourth internal passage with an axial opening aligned with said axial opening of said sleeve and a lateral opening alignable with said lateral opening of said sleeve, said piston including means engagable by said lever for moving said piston away from said valve seat;

a spring urging said piston toward said valve seat;

a plunger threadedly mounted in said fourth internal passage of said piston, with said plunger movable toward and away from said axial opening of said piston for controlling fuel flow through said internal passage; and means for disabling said vacuum actuator to close said air flow path of said first passage for a predetermined period of time blocking flow of pre-mix air to said nozzle during starting of the engine, said disabling means having a cold start valve positioned at an opening to atmospheric air in said vacuum actuator, with said valve having an open position providing communication between the atmospheric and said valve actuator opening, and a closed position blocking communication between the atmosphere and said valve actuator opening.

7. In a carburetor for an internal combustion engine, said carburetor having a throat, a first butterfly valve upstream of said throat, a second butterfly valve downstream of said throat, an outlet downstream of said second butterfly valve, a fuel nozzle in said throat, a pre-mix air supply passage providing an air flow path from the exterior of said carburetor to said nozzle, a needle valve in said air flow path, a vacuum actuator for actuating said needle valve, and a vacuum line connecting said outlet to said vacuum actuator, the improvement comprising means for disabling said vacuum actuator to close said air flow path for a predetermined period of time blocking flow of pre-mix air to said nozzle during starting of the engine, said disabling means including a cold start valve positioned in said vacuum line, with said valve having an open position providing communication between said outlet and said vacuum actuator, and a closed position blocking communication between said outlet and said vacuum actuator, and said cold start valve including a thermal responsive element for said open and closed operation, and a resistance heater for heating said thermal responsive element.

* * * * *